US007860434B2

(12) United States Patent
Jeon

(10) Patent No.: US 7,860,434 B2
(45) Date of Patent: Dec. 28, 2010

(54) DEVELOPING CARTRIDGE AND IMAGE FORMING APPARATUS INCLUDING THE SAME

(75) Inventor: In-cheol Jeon, Yongin-si (KR)

(73) Assignee: Samsung Electronics Co., Ltd, Suwon-si (KR)

( * ) Notice: Subject to any disclaimer, the term of this patent is extended or adjusted under 35 U.S.C. 154(b) by 599 days.

(21) Appl. No.: 11/865,814

(22) Filed: Oct. 2, 2007

(65) Prior Publication Data

US 2008/0175623 A1 Jul. 24, 2008

(30) Foreign Application Priority Data

Jan. 19, 2007 (KR) ..... 10-2007-0005898

(51) Int. Cl.
*G03G 15/08* (2006.01)

(52) U.S. Cl. ..... 399/119; 399/222

(58) Field of Classification Search ..... 399/167, 399/111, 119, 222
See application file for complete search history.

(56) References Cited

U.S. PATENT DOCUMENTS

| | | | | |
|---|---|---|---|---|
| 4,951,093 | A * | 8/1990 | Ishii et al. | 399/119 |
| 5,126,800 | A * | 6/1992 | Shishido et al. | 399/111 |
| 7,283,769 | B2 * | 10/2007 | Noh | 399/167 |
| 7,319,836 | B2 * | 1/2008 | Kuroda | 399/167 |
| 7,386,258 | B2 * | 6/2008 | Jang et al. | 399/222 |
| 7,430,387 | B2 * | 9/2008 | Kim et al. | 399/167 |
| 7,627,271 | B2 * | 12/2009 | Ookushi et al. | 399/222 |
| 2005/0141921 | A1 * | 6/2005 | Baek | 399/167 |
| 2005/0169670 | A1 * | 8/2005 | Noh | 399/167 |

FOREIGN PATENT DOCUMENTS

| | | | |
|---|---|---|---|
| JP | 01166075 | A * | 6/1989 |
| JP | 8-110746 | | 4/1996 |
| JP | 09114160 | A * | 5/1997 |
| JP | 10-326034 | | 12/1998 |
| JP | 2000-275933 | | 10/2000 |
| JP | 2003-148503 | | 5/2003 |
| JP | 2003-184902 | | 7/2003 |
| JP | 2005-92223 | | 4/2005 |
| KR | 2003-28585 | | 4/2003 |
| KR | 2003-43141 | | 6/2003 |

* cited by examiner

*Primary Examiner*—Susan S Lee
(74) *Attorney, Agent, or Firm*—Stanzione & Kim LLP

(57) ABSTRACT

A developing cartridge includes a body frame, a photosensitive body having a shaft, a developing unit having a shaft in parallel to the photosensitive body, a driven part that is rotatably joined to the shaft of the developing unit, a transmission part that has a transmission shaft in parallel to the shaft of the developing unit and is connected to the driven part in a transmittable manner, a unit casing that rotatably supports the shaft of the developing unit and the transmission shaft, is rotatably supported to the body frame, and controls the developing unit to approach the photosensitive body when the unit casing rotates in the same direction as a rotation direction of the photosensitive body, and a driving part that is provided in the body frame and rotates the transmission part in the same direction as the rotation direction of the photosensitive body.

19 Claims, 13 Drawing Sheets

DEVELOPING CARTRIDGE AND IMAGE FORMING APPARATUS INCLUDING THE SAME

CROSS-REFERENCE TO RELATED APPLICATIONS

This application claims priority from Korean Patent Application No. 10-2007-0005898, filed on Jan. 19, 2007 in the Korean Intellectual Property Office, the disclosure of which is incorporated herein in its entirety by reference.

BACKGROUND OF THE INVENTION

1. Field of the Invention

The present general inventive concept relates to a developing cartridge, and more particularly, to a developing cartridge with an improved power transmission structure that transmits power to a developing unit so that the developing unit can keep a developing gap constant.

2. Description of the Related Art

An image forming apparatus of an electrophotography type forms an image on a print medium using toner in a sequential order of static electricity erasing, charging, exposing, developing, transferring, and fixing operations. An example of the image forming apparatus may include a copy machine, a laser printer and so on. Such an electrophotography-typed image forming apparatus has a developing cartridge that is detachably provided in a body of the image forming apparatus and stores toner.

As illustrated in FIGS. 1 to 3, a conventional developing cartridge 1 includes a photosensitive unit 30 including a photosensitive drum 33, and a developing unit 20 including a developing roller 23.

The photosensitive unit 30 further includes a cleaning blade 35 that cleans out used toner adhering to a surface of the photosensitive drum 33 after an image is transferred into a print medium, and a charging roller 31 that contacts and charges the photosensitive drum 33. A shaft 33*a* of the photosensitive drum 33 is inserted and rotatably supported in shaft holes 43 of side frames 40 that are provided in opposite sides of the developing cartridge 1. A photosensitive body driven coupling (not illustrated) for receiving power from an internal main driver of an image forming apparatus (not illustrated) is provided at one end portion of the shaft 33*a* when the developing cartridge 1 is mounted in the image forming apparatus. The main driver of the image forming apparatus includes a photosensitive body driving coupling (not illustrated) that engages with the photosensitive body driven coupling in the direction of the shaft 33*a*. The photosensitive body driving coupling is driven by a driving motor (not illustrated) provided in the body of the image forming apparatus.

The developing unit 20 develops the photosensitive drum 33 with toner stored in a unit casing 21. The unit casing 21 rotatably supports an agitator 29 that feeds the toner to a supplying roller 25, the supplying roller 25 that frictionally charges the toner fed from the agitator 29, and the developing roller 23 that develops the photosensitive drum 33 with the frictionally-charged toner using an electric force. A doctor blade 27 is illustrated in the developing unit 20 to regulate a thickness of the toner attached to the developing roller 23.

In addition, the developing unit 20 includes an agitator gear 29*a* connected to a shaft of the agitator 29, and transmission gears 26 and 28 that are interposed between the agitator gear 29*a* and a driven coupling 67, which will be described later, and transmit a rotatory power of the driven coupling 67 to the agitator 29*a*. A support plate 24 that rotatably supports the transmission gears 26 and 28 and the driven coupling 67 is joined to the unit casing 21 in such a manner that an inter axial distance between the transmission gears 26 and 28 and the driven coupling 67 can keep constant.

On the other hand, the developing unit 20 is provided to pivotally rotate around a hinge shaft 10. That is, the hinge shaft 10 is inserted in the support plate 24 and is rotatably supported by the side frames 40. In addition, the side frames 40 are respectively connected to projections 21*a* of the unit casing 21 through elastic members in order to restrain the developing unit 20 from excessively rotating around the hinge shaft 10. Accordingly, the developing unit 20 rotates around the hinge shaft 10 to some proper extent.

In addition, as illustrated in FIGS. 2 and 3, the conventional developing cartridge 1 has a power transmission structure to rotate a rotating body of the developing unit 20. The driven coupling 67 illustrated in FIG. 3 is joined to one end of a shaft (23*a* of FIG. 1) of the developing roller 23. The driven coupling 67 has an engaging member 67*b* which is formed on an outer circumference surface of the driven coupling 67 and is engaged with the transmission gear 26.

In addition, a driving coupling 63, which is joined to the driven coupling 67 in the direction of the shaft (23*a* of FIG. 1) of the developing roller 23, is rotatably supported to the right side frame (not illustrated) facing the left side frame 40 illustrated in FIG. 2.

The driving coupling 63 and the driven coupling 67 have two driving projections 63*a* and two driven projections 67*a*, respectively, which project toward each other. The driving projections 63*a* and the driven projections 67*a* are spaced from each other in a circumferential direction, and are inserted in projection grooves 65*a* of a rotating disk 65. The rotating disk 65 is joined to and integrally rotates with the driven coupling 67.

The driving coupling 63 receives the rotatory power from the internal main driver of the image forming apparatus when the developing cartridge 1 is mounted in the image forming apparatus. The power transmission system uses the driving coupling 63 and the driven coupling 67 to transmit a rotatory driving force to the developing roller 23 uniformly when the developing unit 20 rotates.

In addition, the developing unit 20 and the photosensitive unit 30 receive power from the main driver through different power transmission structures.

On the other hand, as illustrated in FIGS. 4A and 4B, as the developing roller 23 rotates in an opposite direction (counterclockwise direction indicated by D in FIG. 1) to a rotation direction (clockwise direction indicated by C in FIG. 1) of the photosensitive roller 23, the driving coupling 63 is driven in the counterclockwise direction. Accordingly, the driving projections 63*a* also rotate in the counterclockwise direction, thereby rotating the rotating disk 65 and the driven coupling 67 in the same direction.

As illustrated in FIG. 4A, however, when first and second driving projections 63*a*1 and 63*a*2 are disposed in a radical direction of the hinge shaft 10, a moment arm r1 of a first driving projection 63*a*1 centering around the hinge shaft 10 of the developing unit 20 is shorter than a moment arm r2 of a second driving projection 63*a*2, and a force F applied to the rotating disk 65 by the first driving projection 63*a*1 is nearly equal in magnitude to a force F applied to the rotating disk 65 by the second driving projection 63*a*2. Accordingly, a rotation moment M2, which is caused by the second driving projection 63*a*2, rotating around the hinge shaft 10 of the developing unit 20 is larger than a rotation moment M1, which is caused by the first driving projection 63*a*1, rotating around the hinge shaft 10 of the developing unit 20. Accordingly, the developing unit 20 becomes away from the photosensitive drum 33 by a resultant rotation moment M0 which is the sum of rotation moments M1 and M2.

On the other hand, as illustrated in FIG. 4B, when the first and second driving projections 63*a*1 and 63*a*2 are disposed opposite to each other with respect to a radical direction of the hinge shaft 10, that is, when the moment arm r1 of the first driving projection 63*a*1 rotating around the hinge shaft 10 is equal to the moment arm r2 of the second driving projection 63*a*2, the rotation moment M2 which is caused by the second driving projection 63*a*2 is in equilibrium with the rotation moment M1 which is caused by the first driving projection 63*a*1, and accordingly, the resultant rotation moment M0 applied to the developing unit 20 becomes zero.

FIG. 5 illustrates arrangement of the resultant rotation moments M0 of FIGS. 4A and 4B, that is, a change of the resultant rotation moments M0 with respect to a time axis. As illustrated in FIG. 5, when the driving coupling 63 rotates one time, the resultant rotation moment M0 reaches the maximum value two times, and always has (+) values except when the moment arms r1 and r2 are equal to each other as illustrated in FIG. 4B. Here, a rotation moment in a direction in which the developing unit 20 is away from the photosensitive drum 33 is defined to have a (+) value.

On the other hand, a method of developing the photosensitive drum 33 may include a contact method of the developing the photosensitive drum 33 at a developing nip at which the developing roller 23 contacts the outer circumference surface of the photosensitive drum 33 and a non-contact method of developing the photosensitive drum 33 through a developing gap which is interposed between the developing roller 23 and the photosensitive drum 33 to make them distanced apart from each other.

However, in the conventional developing cartridge 1, since the resultant rotation moment M0 always has the (+) values, the developing roller 23 suffers from a rotation moment by which the developing roller 23 is spaced from the photosensitive drum 33. Accordingly, the developing nip or the developing gap varies with respect to the time axis. Thus, concentration of an image periodically varies in a longitudinal direction of a print medium, which results in deterioration of print quality.

Particularly, in a case of the non-contact method, it can be seen from FIG. 6 that aged toner stored in the unit casing 21 responds more sensitively to change of the developing gap than fresh toner, which leads to a rapid change of concentration of an image. Accordingly, since aged toner increases with increase of use time of the developing cartridge, print quality is more deteriorated.

SUMMARY OF THE INVENTION

The present general inventive concept provides a developing cartridge which is capable of improving print quality, and an image forming apparatus including the same.

The present general inventive concept also provides a developing cartridge which is capable of reducing a temporal change of print quality.

Additional aspects and utilities of the present general inventive concept will be set forth in part in the description which follows and, in part, will be obvious from the description, or may be learned by practice of the general inventive concept.

The foregoing and/or other aspects and utilities of the present general inventive concept can be achieved by providing a developing cartridge comprising a body frame, a photosensitive body having a shaft, a developing unit having a shaft in parallel to the photosensitive body, a driven part that is rotatably joined to the shaft of the developing unit, a transmission part that has a transmission shaft in parallel to the shaft of the developing unit and is connected to the driven part in a transmittable manner, a unit casing that rotatably supports the shaft of the developing unit and the transmission shaft, is rotatably supported to the body frame, and controls the developing unit to approach the photosensitive body when the unit casing rotates in the same direction as a rotation direction of the photosensitive body, and a driving part that is provided in the body frame and rotates the transmission part in the same direction as the rotation direction of the photosensitive body.

The driven part may have a pinion engaging part and the transmission part has a transmission engaging part that is engaged with the pinion engaging part.

The transmission part may have a driven coupling part formed in a direction of the transmission shaft and the driving part has a driving coupling part that is engaged with the driven coupling part in the direction of the transmission shaft.

The developing cartridge may further include a rotating disk, the driven coupling part may include a plurality of driven projections that projects toward the driving coupling part and is inserted in the rotating disk, and the driving coupling part may include a plurality of driving projections that projects toward the driven coupling part and is inserted in the rotating disk, the driving projections being spaced from the driven projections in a predetermined direction.

The developing cartridge may further include a gap maintaining member that is provided at opposite end parts of one of the shaft of the photosensitive body and the shaft of the developing unit and maintains a gap between the photosensitive body and the developing unit.

The foregoing and/or other aspects and utilities of the present general inventive concept can also be achieved by providing an image forming apparatus comprising a developing cartridge that comprises a body frame, a photosensitive body, a developing unit having a shaft in parallel to the photosensitive body, a driven part that is rotatably joined to the shaft of the developing unit, a transmission part that has a transmission shaft in parallel to the shaft of the developing unit and is connected to the driven part in a transmittable manner, a unit casing that rotatably supports the shaft of the developing unit and the transmission shaft, is rotatably supported to the body frame, and controls the developing unit to approach the photosensitive body if the unit casing rotates in the same direction as a rotation direction of the photosensitive body, and a cartridge driving part that is provided in the body frame and rotates the transmission part in the same direction as the rotation direction of the photosensitive body, and a main driving part that rotates the cartridge driving part.

The driven part may have a pinion engaging part and the transmission part has a transmission engaging part that is engaged with the pinion engaging part.

The transmission part may have a driven coupling part formed in a direction of the transmission shaft and the driving part has a driving coupling part that is engaged with the driven coupling part in the direction of the transmission shaft.

The developing cartridge may further include a rotating disk, the driven coupling part may include a plurality of driven projections that projects toward the driving coupling part and is inserted in the rotating disk, and the driving coupling part may include a plurality of driving projections that projects toward the driven coupling part and is inserted in the rotating disk, the driving projections being spaced from the driven projections in a predetermined direction.

The developing cartridge may further include a gap maintaining member that maintains a gap between the photosensitive body and the developing unit.

The foregoing and/or other aspects and utilities of the present general inventive concept can also be achieved by providing a developing cartridge including a developing unit having a developing shaft, a transmission part having a transmission shaft spaced apart from the developing shaft by a distance in a radial direction of the developing shaft, a coupling part disposed to transfer a rotation power from an external source to the developing shaft through the transmission part.

The coupling part may include a rotation disk, a driving part to transfer the rotation power from an external source to the disk, a driving part to receive the rotation power from the rotation disk to rotate the transfer shaft.

The coupling part may include a rotation disk having first and second grooves spaced apart from each other in a circumferential direction of the rotation disk, a driving part and a driven part received in corresponding ones of the first and second grooves to transfer the rotation power to the developing part through the transmission part.

The coupling part may include first portions spaced apart from a rotation axis of the transfer shaft to receive the rotation power from an external source and second portions spaced apart from the rotation axis of the transfer shaft to transfer the received rotation power to the developing shaft.

The coupling part may rotate together with the transmission shaft with respect to a rotation axis of the transmission shaft, the coupling part and the transmission shaft rotates in a first direction, and the developing unit rotates a second direction opposite to the first direction.

The coupling part may generate a rotation moment to the transmission part, the rotation moment is in a range between a neutral moment and a negative moment where the transmission part is biased toward the developing unit.

The rotation moment may not be in a range between the neutral moment and a positive moment when the transmission part is biased away from the developing unit.

The coupling part and the transmission part may rotates with respect to a first rotation axis in a first direction, and the developing unit may rotate with respect to a second rotation axis different from the first rotation axis in a second direction.

The developing cartridge may further include a unit casing to rotatably support the developing shaft and the transmission shaft, and a hinge shaft around which the unit casing is disposed to rotate, and the coupling part may generate a moment applied to the transmission part to move with respect to the developing unit while rotating in a different direction from the developing unit.

A line connecting centers of the hinge shaft and the transmission shaft may form an angle with a line connecting centers of the hinge shaft and the developing unit, and the angle may be greater than an angle formed by the line connecting the hinge shaft and the developing unit and a line connecting the center of the hinge shaft and a circumference of the developing unit.

BRIEF DESCRIPTION OF THE DRAWINGS

These and/or other aspects and utilities of the present general inventive concept will become apparent and more readily appreciated from the following description of the embodiments, taken in conjunction with the accompanying drawings of which.

DETAILED DESCRIPTION OF THE PREFERRED EMBODIMENTS

Figure 1:
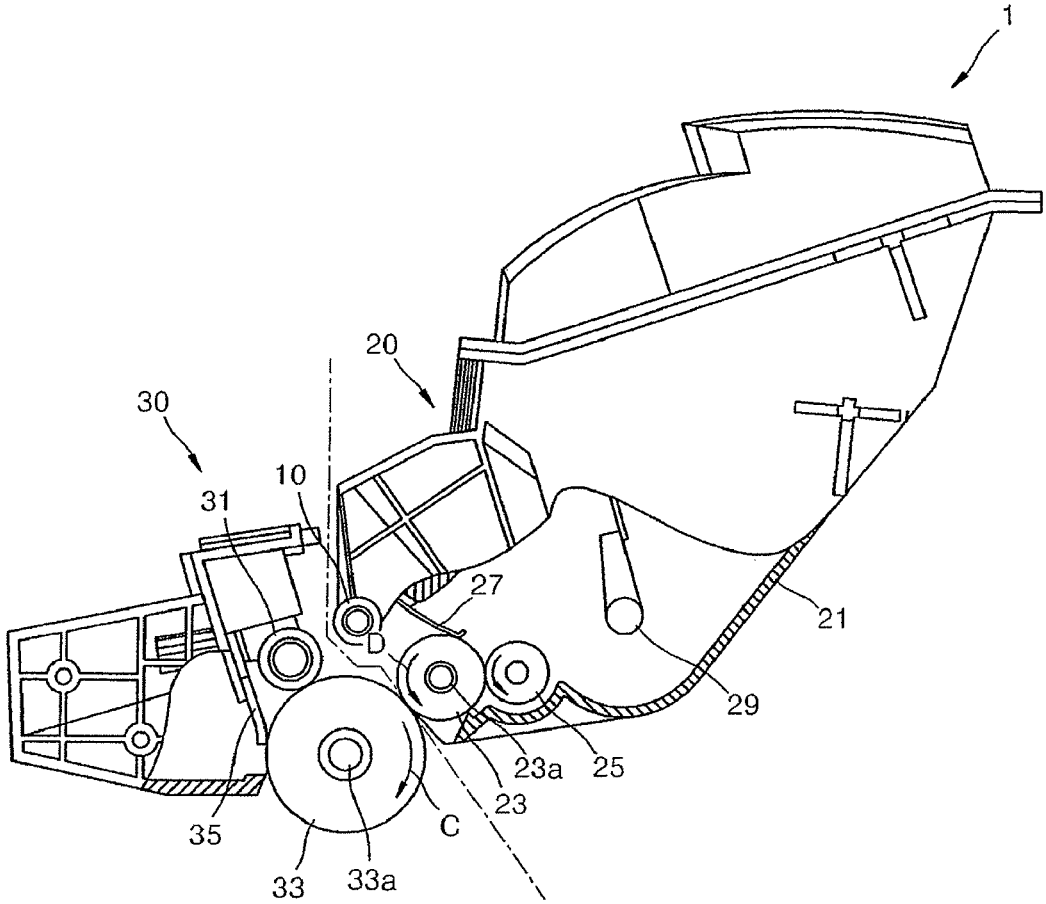
FIG. 1 (RELATED ART)
FIG. 1 is a sectional view illustrating a conventional developing cartridge.
Figure 2:
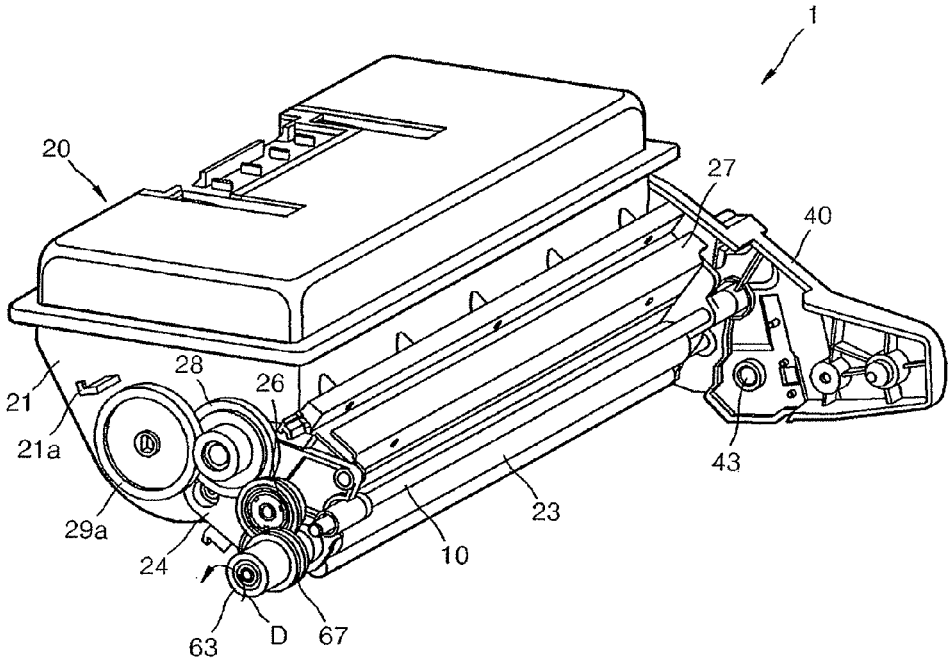
FIG. 2 (RELATED ART)
FIG. 2 is an enlarged perspective view illustrating a developing unit of the developing cartridge of FIG. 1.
Figure 3:
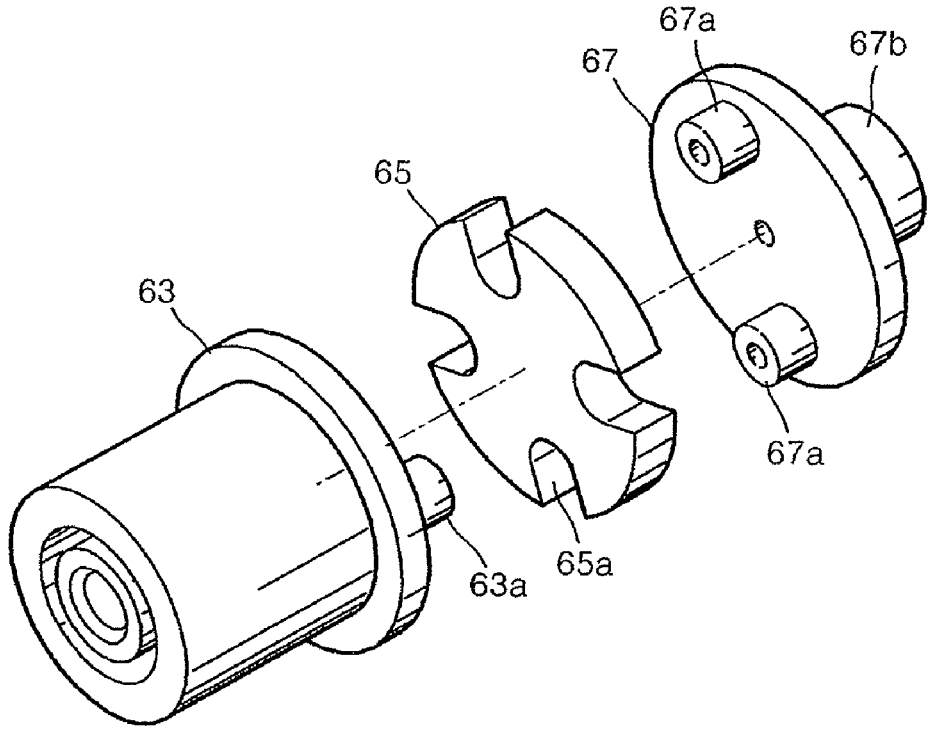
FIG. 3 (RELATED ART)
FIG. 3 is an enlarged perspective view illustrating a structure in which power is transmitted to a developing roller of the developing cartridge of FIG. 1.
Figure 4A:
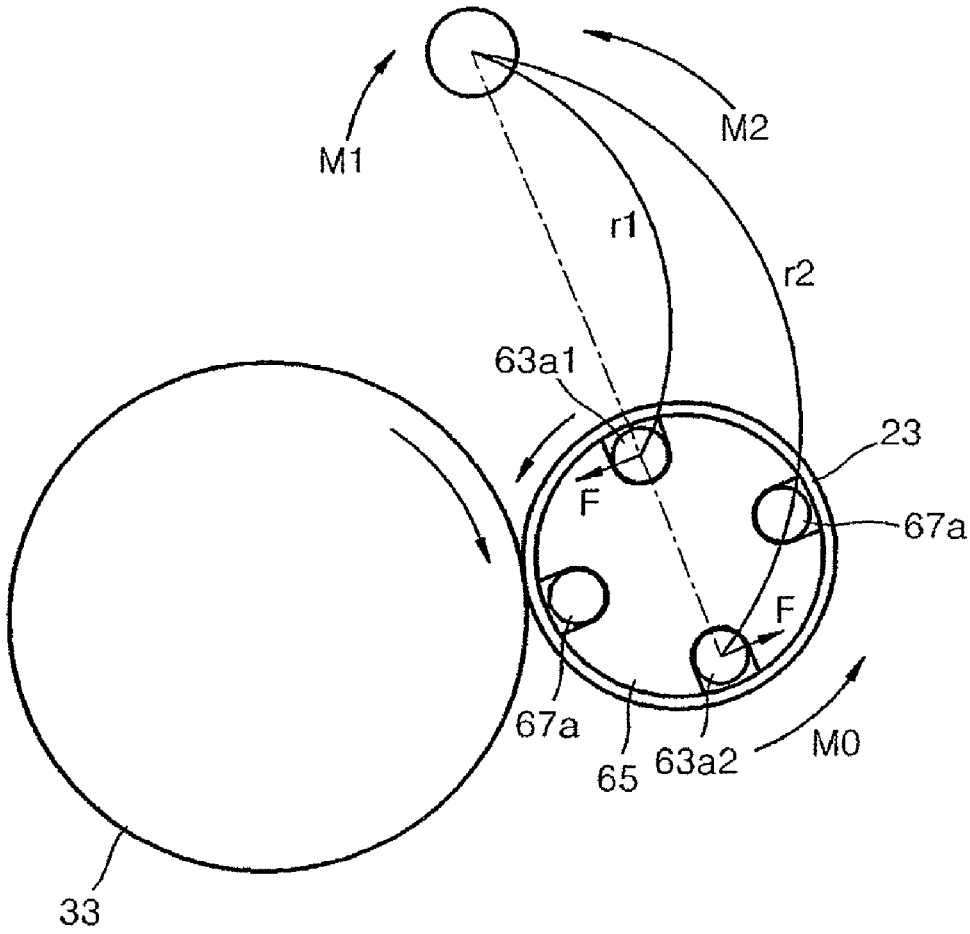
FIG. 4A (RELATED ART)
FIGS. 4A and 4B are schematic sectional views illustrating rotation moments which cause variation of a developing gap of the developing cartridge of FIG. 1.
Figure 4B:
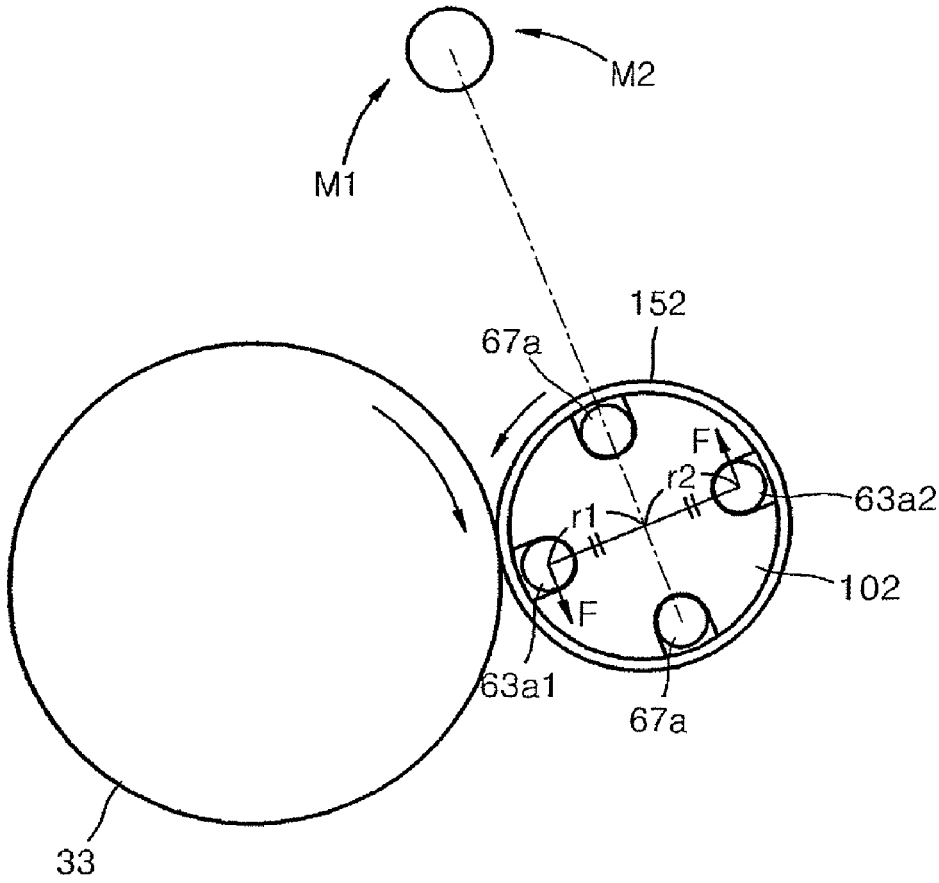
FIG. 4B (RELATED ART)
Figure 5:
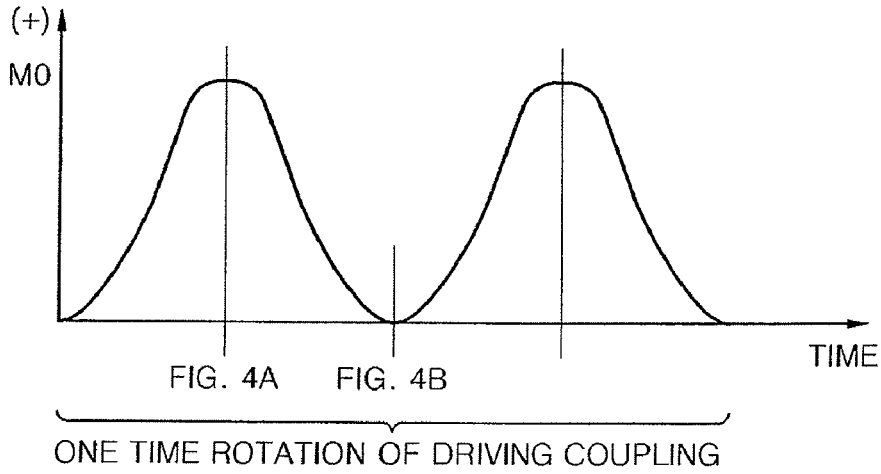
FIG. 5 (RELATED ART)
FIG. 5 is a graph illustrating a change of a rotation moment applied to the developing unit of the developing cartridge of FIG. 1.
Figure 6:
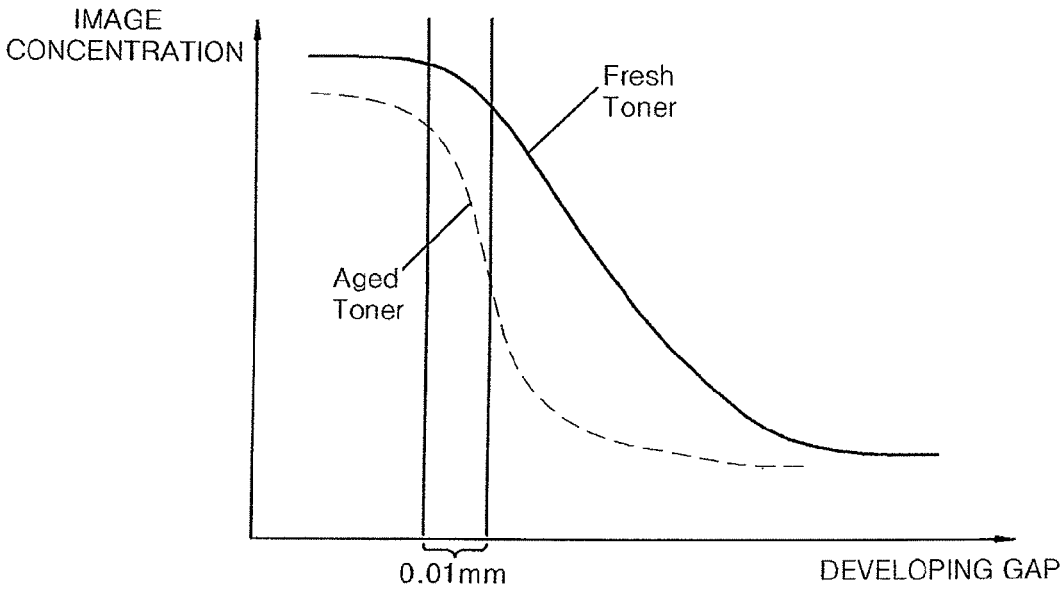
FIG. 6 (RELATED ART)
FIG. 6 is a graph illustrating a change of image concentration depending on a change of the developing gap of the developing cartridge of FIG. 1.

Reference will now be made in detail to the embodiments of the present general inventive concept, examples of which are illustrated in the accompanying drawings, wherein like reference numerals refer to like elements throughout. The exemplary embodiments are described below so as to explain the present general inventive concept by referring to the figures.

Figure 7:
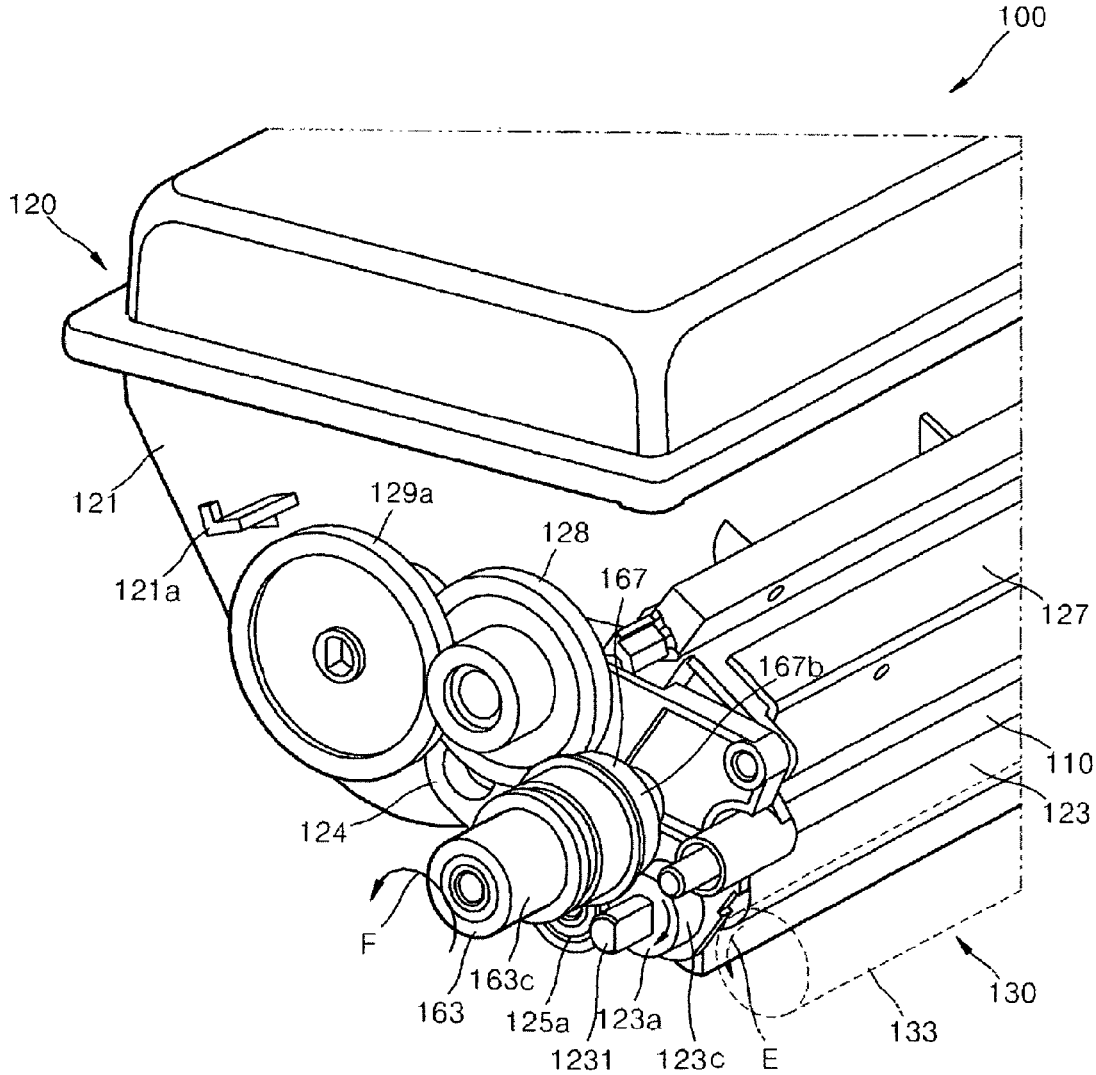
FIG. 7 is an enlarged perspective view illustrating a developing cartridge usable with an image forming apparatus according to an exemplary embodiment of the present general inventive concept.

FIG. 7 is a perspective view illustrating a developing cartridge 100 usable with an image forming apparatus according to an exemplary embodiment of the present general inventive concept in which a right side frame (150 in FIG. 8) is not illustrated for the sake of convenience of description.

As illustrated in FIG. 7, the developing cartridge 100 includes a photosensitive unit 130 including a photosensitive body 133, and a developing unit 120 including a developing part 123. The developing part 123 may be a developing roller rotatable about a rotation axis thereof parallel to a rotation axis of the photosensitive body 133.

The photosensitive unit 130 may have the same configuration and operation as the photosensitive unit 30 of the conventional developing cartridge 1, and therefore, details of which will be omitted for the sake of avoiding repetitive description. However, the photosensitive body 133 may be used with a belt type instead of the drum type illustrated in FIG. 7, as necessary. In addition, the photosensitive body 133 may be modified in various forms as long as charged toner can be adhered to the photosensitive body 133 to form a toner visible image.

The developing unit 120 includes the developing part 123, a driven part 123*a* joined to a shaft 1231 of the developing part 123, a transmission part 167 that has a transmission shaft 168 in parallel to the shaft 1231 and rotates the driven part 123*a*, and a driving part 163 that drives the transmission part 167.

As necessary, the developing part 123 may be provided as a belt type instead of the roller type of FIG. 7. In addition, the developing part 123 may be modified in various forms as long as it can supply toner to the photosensitive body 133 and develop an electrostatic latent image on the photosensitive body 133 with the toner.

The driven part 123*a* may be provided as a pinion having a pinion engaging part 123*c* formed on its outer circumference surface. The transmission part 167 may have a transmission engaging part 167*b* that is engaged with the pinion engaging part. As necessary, each of the driven part 123*a* and the transmission part 167 includes a friction wheel to rotate the driven part 123*a* and the transmission part 167.

Figure 8:
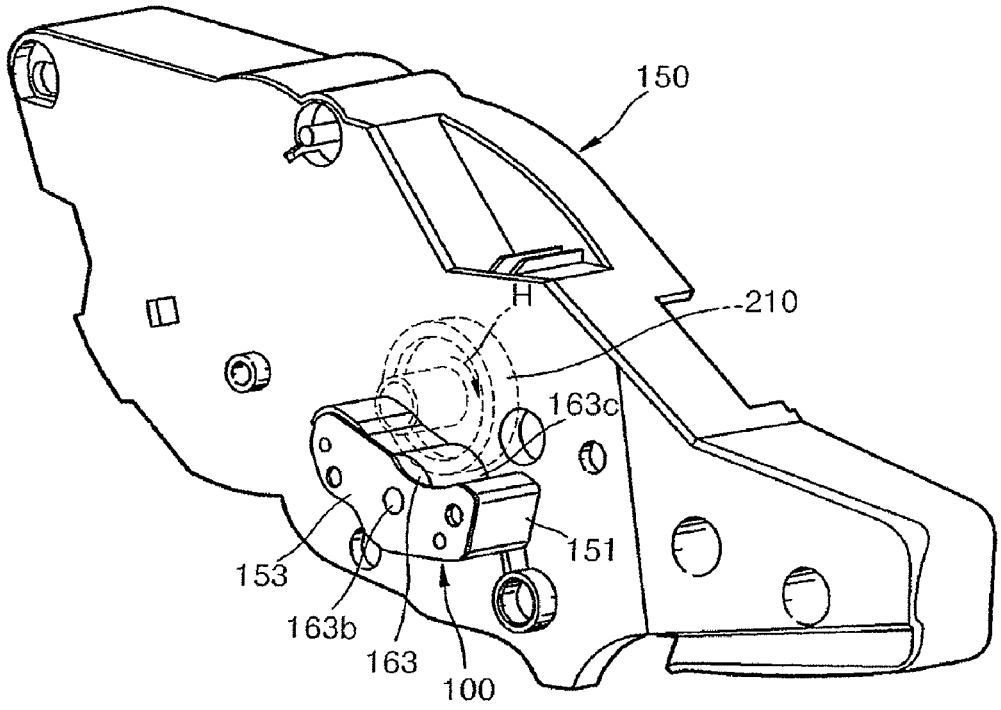
FIG. 8 is a perspective view illustrating a side frame mounted on one side of the developing cartridge of FIG. 7.

When the developing cartridge 100 is mounted in the image forming apparatus, the driving part 163 receives rotation driving power from an internal main driver 210 of FIG. 8 of the image forming apparatus and rotates the transmission part 167 in the same direction F as a rotation direction E of the photosensitive body 133. To this end, as illustrated in FIG. 8, the main driver 210 is provided to rotate the driving part 163 in an opposite direction H to the rotation direction E of the photosensitive body 133. The driving part 163 may be also referred to as a cartridge driver.

In addition, as illustrated in FIG. 8, the driving part 163 is rotatably supported to the right side frame 150. In addition, the driving part 163 may be provided at a projection 151 projecting from the right side frame 150 to an outside of the developing cartridge 100.

A bracket 153 is provided in the projection 151 to prevent the driving part 163 from being separated from the driving part 163 during actuation. In addition, both ends of a shaft 163*b* of the driving part 163 may be rotatably supported to the bracket 153 and the side frame 150.

In addition, as illustrated in FIGS. 7 and 8, the driving part 163 may have an engaging part 163*c* formed on its circumference surface so that the driving part 163 can engage with the main driver 210 of the image forming apparatus.

Figure 9A:
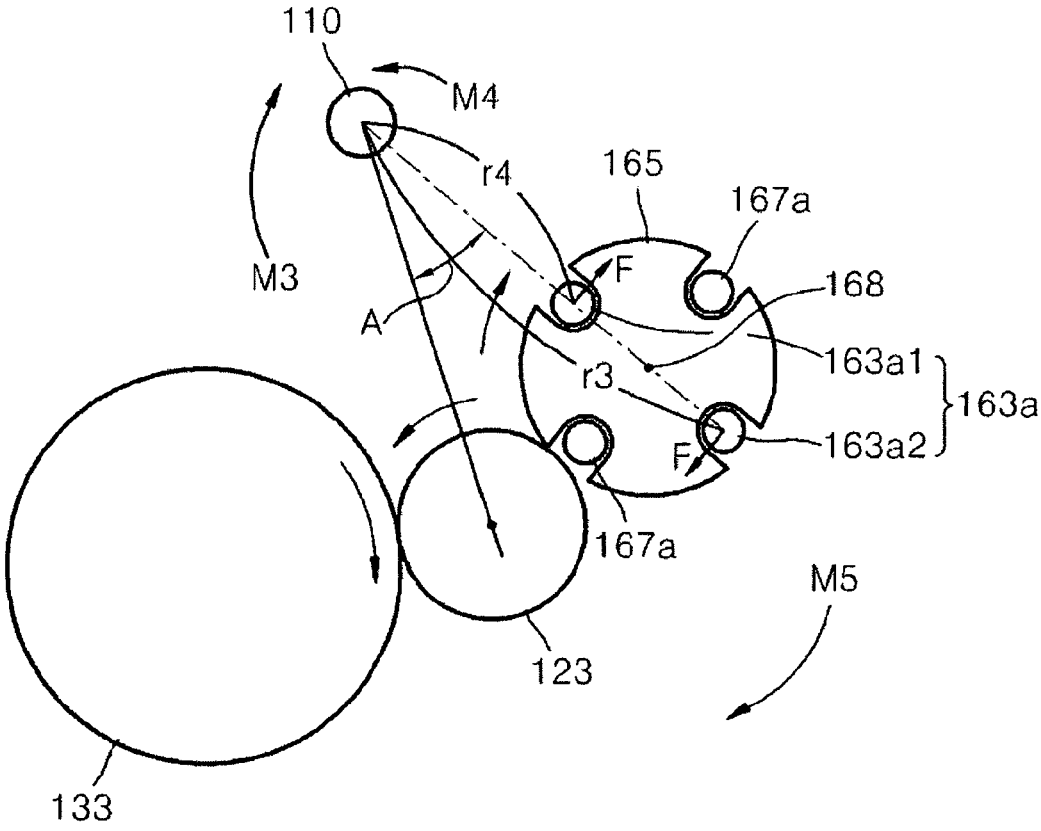
FIGS. 9A and 9B are schematic sectional views illustrating rotation moments which cause variation of a developing gap of the developing cartridge of FIG. 7.
Figure 9B:
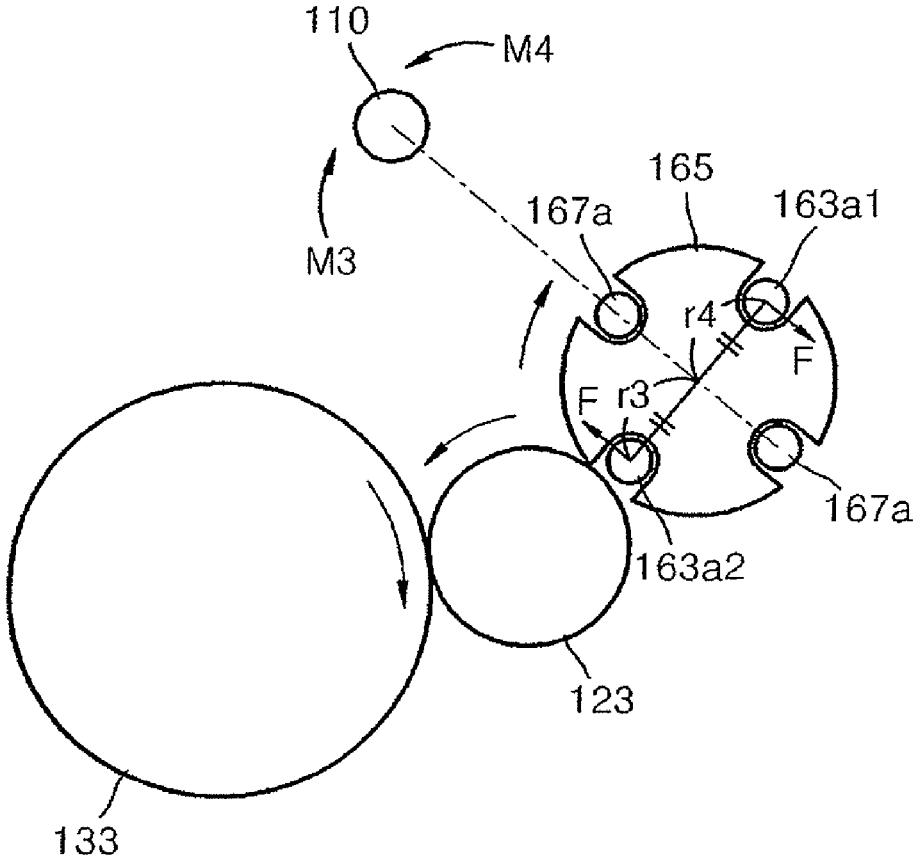

On the other hand, as illustrated in FIGS. 9A and 9B, the driving part 163 and the transmission part 167 may include a driving coupling part 163*a* and a driven coupling part 167*a*, respectively. The driving coupling part 163*a* and the driven coupling part 167*a* are interconnected in a transmission shaft direction. As necessary, as long as the developing unit 120 continues to transmit power while rotating around a hinge shaft 110, the driving part 163 and the transmission part 167 may be interconnected in a direction transverse to the transmission shaft. In addition, the shaft 163*b* of the driving part 163 may be in eccentricity with a rotational axis of the transmission shaft 168.

In the present exemplary embodiment, the driving coupling part 163*a* may be provided as a plurality of driving projections 163*a* (163*a*1 and 163*a*2) projecting toward the transmission part 167 along the shaft 163*b*. In addition, the driven coupling part 167*a* may be provided as a plurality of driven projections 167*a* projecting toward the driving coupling part 167*a* along the transmission shaft.

The plurality of driving projections 163*a* and the plurality of driven projections 167*a* are inserted in a rotating disk 165 in such a manner that the projections 163*a* and 167*a* are spaced from each other in a circumferential direction.

In the rotating disk 165, insertion grooves 165*a* are formed in a circumferential direction of the rotating disk 165 and spaced apart from each other such that the projections 163*a* and 167*a* are inserted and spaced from each other in the circumferential direction. The rotating disk 165 is joined to and integrally rotates with the transmission part 167. Accordingly, as the driving projections 163*a* rotates, the rotating disk 165 and the driven coupling part 167 rotate in the same direction.

If necessary, the driving coupling part 163*a* and the driven coupling part 167*a* may be provided in various forms as long as they can transmit rotation power, unlike the shape illustrated in the FIGS. 9A and 9B. For example, the driving coupling part 163*a* may be provided as a projecting male coupling having a polygonal section and the driven coupling part 167*a* may be provided as a corresponding female coupling having the corresponding shape to receive the projecting male coupling.

As illustrated in FIG. 7, the transmission part 167 may have a transmission engaging part 167*b* that is formed on the outer circumference surface of the transmission part 167 and is engaged with a transmission gear 128 and a pinion engaging part 123*c* of the driven part 123*a*.

The developing unit 120 may further include an agitator (not illustrated) that agitates toner stored in the unit casing 121 and feeds the agitated toner to a supplying roller (not illustrated), and the supplying roller (not illustrated) that rotatably contacts the developing part 123 and charges the toner fed from the agitator. The agitator and the supplying roller may be the same as an agitator 29 and the supply roller 25 of the unit casing 21 of the conventional developing cartridge 1 of FIG. 1.

In addition, as illustrated in FIG. 7, the developing unit 120 may further include an agitator gear 129*a* joined to a shaft of the agitator, a supply roller gear 125*a* that is joined to a shaft of the supply roller and is engaged with the pinion engaging part of the driven part 123*a*, and a transmission gear 128 that is interposed between the driven coupling part 167 and the agitator gear 129*a* and transmits the rotation power of the driven coupling part 167 to the agitator. A reference numeral 127 denotes a doctor blade which has the same shape and operation as a doctor blade 27 illustrated in FIG. 1.

In addition, the developing unit 120 further includes the unit casing 121 in which toner is stored.

As the unit casing 121 rotates around the hinge shaft 110 in the same direction as the rotation direction F of the photosensitive body 133, the developing part 123 approaches the photosensitive body 133.

In addition, the unit casing 121 may include a support plate 124 that rotatably supports the driven coupling part 167, the shaft of the supply roller (not illustrated), the transmission gear 128, and the rotation shaft 1231 of the developing part 123. The support plate 124 may be provided separately from the unit casing 121 and may be coupled to and integrally rotate with the unit casing 121.

The unit casing 121 is provided to rotate around the hinge shaft 110. That is, the hinge shaft 110 is inserted in the support plate 124 and opposite ends of the inserted hinge shaft 110 are pivotally supported to the side frames 150 installed at opposite sides of the developing cartridge 100. In addition, the side frames 150 are respectively connected to the projections 121*a* of the unit casing 121 through elastic members (not illustrated) in order to restrain the developing unit 120 (exactly, the unit casing 121) from excessively rotating around the hinge shaft 110. Accordingly, the unit casing 121, that is, the developing unit 120, rotates around the hinge shaft 10 to some proper extent. The side frames 150 may be also referred to as a body frame. The body frame may be provided in various forms as long as it can rotatably support the unit casing 121. However, the present general inventive concept is not limited to the shape of the side frames 150.

Hereinafter, rotation moments with respect to the hinge shaft 110, which are applied to the developing unit 120 when the developing cartridge 100 as constructed above is mounted in the image forming apparatus, will be described with reference to FIGS. 9A and 9B.

As illustrated in FIG. 9A, a moment arm r4 of a first driving projection 163*a*1 rotating around the hinge shaft 110 is shorter than a moment arm r3 of a second driving projection 163*a*2. Accordingly, a rotation moment M3, which is caused by the second driving projection 163*a*2, rotating around the hinge shaft 110 of the developing unit 120 is larger than a rotation moment M4, which is caused by the first driving projection 163*a*1, rotating around the hinge shaft 110 of the developing unit 120. Accordingly, the developing unit 120 rotates to approach or is forced (biased) toward the photosensitive body 133 according to a resultant rotation moment M5 which is a sum of rotation moments M3 and M4.

Of the rotation moments illustrated in FIG. 9A, the resultant rotation moment M5 is the largest rotation moment that has a (−) value and rotates the developing unit 120 to approach the photosensitive body 133.

On the other hand, as illustrated in FIG. 9B, when the moment arm r3 of the first driving projection 163*a*1 rotating around the hinge shaft 110 is equal to the moment arm r4 of the second driving projection 163*a*2, the resultant rotation moment M5 becomes zero.

As illustrated in FIGS. 9A and 9B, a rotation axis of the transmission part 168 and/or the transmission part 167 is spaced apart from a rotation axis of the developing part 123 by a distance such that an angle formed between a line connecting centers of the hinge shaft 110 and the developing part 123 and a line connecting centers of the hinge shaft 110 and the transmission part 167 is greater than an angle formed between a line connecting centers of the hinge shaft 110 and the developing part 123 and a line connecting the centers of the hinge shaft 110 and a circumference of the developing part 123.

Figure 10:
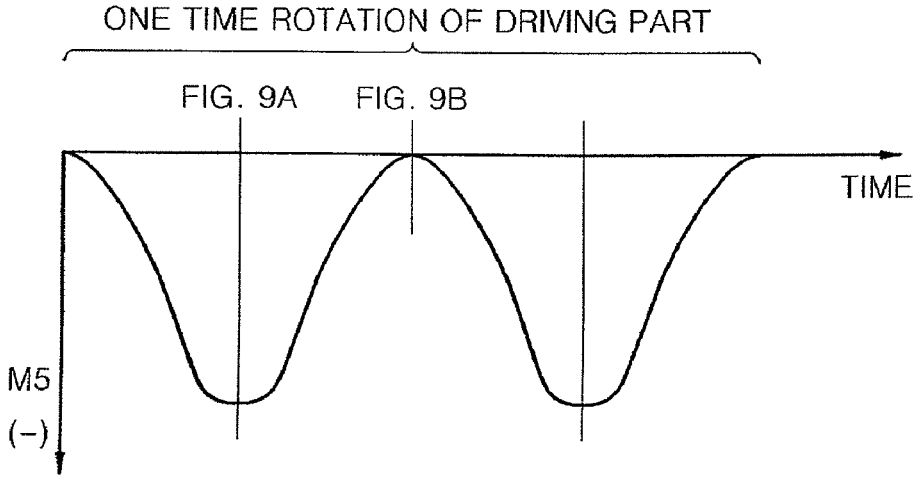
FIG. 10 is a graph illustrating change of a rotation moment applied to the developing unit of the developing cartridge of FIG. 7.

FIG. 10 illustrates arrangements of the resultant rotation moments M0 of FIGS. 9A and 9B to illustrate a change of the resultant rotation moment M5 with respect to a time axis. As illustrated in FIG. 10, when the driving part 163 rotates one time, the resultant rotation moment M5 reaches the minimum value two times, and always has (−) values except when the moment arms r4 and r3 of the first and second driving projections 163*a*1 and 163*a*2 are equal to each other as illustrated in FIG. 9B. That is, the resultant rotation moment M5 rotates the developing unit 120 around the hinge shaft 110 so that the developing part 123 can always approach the photosensitive body 133.

Accordingly, if a contact method is employed as a method of developing the photosensitive body 133, a developing nip can keep constant. If a non-contact method is employed as the method of developing the photosensitive body 133, a developing gap G can be kept as illustrated in FIG. 11.

Figure 11:
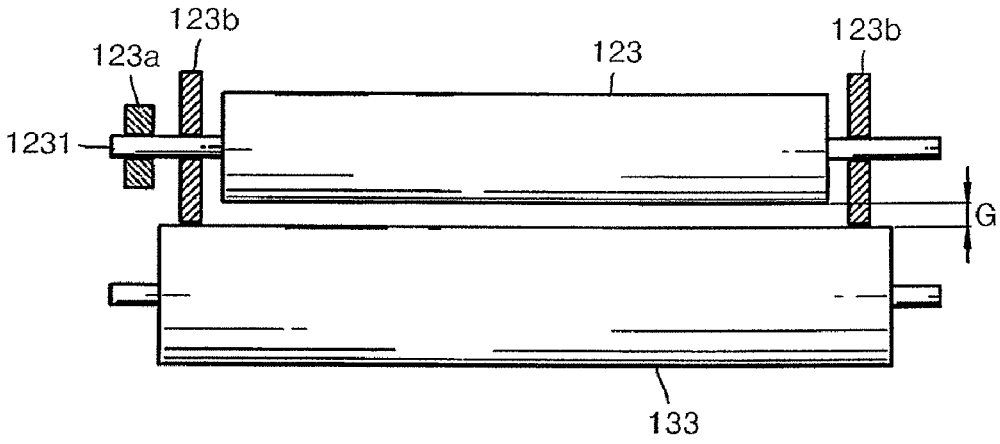
FIG. 11 is an enlarged plan view illustrating the developing cartridge of FIG. 7.

As illustrated in FIG. 11, gap rings 123*b* are joined, as developing gap holding members, to both ends of the shaft 1231 of the developing part 123. At this time, since the resultant rotation moment M5 has the (−) values and accordingly controls the developing part 123 to approach the photosensitive body 133, the gap rings 123*b* can keep in contact with an outer circumference surface of the photosensitive body 133. Accordingly, the developing gap G can keep constant.

Print quality can be improved by keeping the developing nip and the developing gap constant, thereby making concentration of an image constant. In addition, since change of the concentration of the image due to aged toner can be reduced even with long use of the developing cartridge 100, relatively uniform print quality can be maintained for a longer period of time.

In a conventional developing cartridge, since the resultant rotation moment M0 always has the (+) values, the developing part (23 in FIG. 1) is spaced from the photosensitive body (33 in FIG. 1) even when gap rings (not illustrated) are provided, and accordingly, the gap rings may not contact the photosensitive body (33 in FIG. 1) and the developing gap can not keep constant.

The image forming apparatus according to the exemplary embodiment of the present general inventive concept includes the above-described developing cartridge (100 in FIG. 7) and the main driver (210 in FIG. 8) that drives the developing unit (120 in FIG. 7) of the developing cartridge 100. The developing cartridge 100 is detachably provided in a body (not illustrated) of the image forming apparatus. In addition, a photosensitive body driving coupling (not illustrated) that rotates the photosensitive body 133 of the photosensitive unit 130 is provided at a position at which the developing cartridge 100 is mounted in the image forming apparatus.

In addition, the image forming apparatus may further include a paper supply cassette (not illustrated) on which print media such as paper are loaded, and a feed roller (not illustrated) that feeds the loaded print media to the developing cartridge 100.

In addition, the image forming apparatus may further include an optical scanning device (not illustrated) that scans a surface of the photosensitive body 133 of the developing cartridge 100 with light, a transfer roller (not illustrated) and a fixer (not illustrated).

The surface of the photosensitive body 133 of the photosensitive unit 130 is uniformly charged to a potential when the photosensitive body 133 contacts a charging roller (not illustrated). The charged surface of the photosensitive body 133 is exposed by the optical scanning device and is formed thereon an electrostatic latent image by a potential difference between an exposed region and a non-exposed region. The formed electrostatic latent image is developed with the toner stored in the unit casing 121 by means of the developing part 123, and accordingly, a toner visible image is formed on the surface of the photosensitive body 130.

The toner visible image is transferred into a print medium through the transfer roller arranged in parallel to the photosensitive body 133.

The transferred toner visible image is fixed on the print medium by heat and pressure while passing the fixer, and the print medium on which the toner visible image is fixed is discharged to the outside.

As described above, the developing unit 120 has a moment between a neutral moment where the developing unit 120 is not forced to rotate with respect to the hinge shaft 110, and a negative moment where the developing unit 120 is forced to move or rotate toward the photosensitive body 133, compared to a conventional developing unit of FIG. 1 where a developing unit is forced to move or rotate away from a photosensitive body.

As apparent from the above description, the present general inventive concept provides a developing cartridge which is capable of improving print quality with minimal change of concentration of an image, minimizing change of image concentration even with long use of the developing cartridge, and keeping a developing gap or a developing nip constant, and an image forming apparatus including the developing cartridge.

Although a few exemplary embodiments of the present general inventive concept have been shown and described, it will be appreciated by those skilled in the art that changes may be made in these exemplary embodiments without departing from the principles and spirit of the general inventive concept, the scope of which is defined in the appended claims and their equivalents.

What is claimed is:

1. A developing cartridge comprising:

a body frame;

a photosensitive body having a shaft;

a developing unit having a shaft in parallel to the photosensitive body;

a driven part that is rotatably joined to the shaft of the developing unit;

a transmission part that has a transmission shaft in parallel to the shaft of the developing unit and is connected to the driven part in a transmittable manner;

a unit casing that rotatably supports the shaft of the developing unit and the transmission shaft, is rotatably supported to the body frame, and controls the developing unit to approach the photosensitive body when the unit casing rotates in the same direction as a rotation direction of the photosensitive body; and a driving part that is provided in the body frame and rotates the transmission part in the same direction as the rotation direction of the photosensitive body.

2. The developing cartridge according to claim 1, wherein the driven part has a pinion engaging part, and the transmission part has a transmission engaging part that is engaged with the pinion engaging part.

3. The developing cartridge according to claim 1, wherein the transmission part has a driven coupling part formed in a direction of a rotational axis of the transmission shaft, and the driving part has a driving coupling part that is engaged with the driven coupling part in the direction of the rotational axis of the transmission shaft.

4. The developing cartridge according to claim 3, further comprising:

a rotating disk, wherein the driven coupling part comprises a plurality of driven projections that projects toward the driving coupling part and is inserted in the rotating disk, and wherein the driving coupling part comprises a plurality of driving projections that projects toward the driven coupling part and is inserted in the rotating disk, the driving projections being spaced from the driven projections in a predetermined direction.

5. The developing cartridge according to claim 1, further comprising:

a gap maintaining member that is provided at opposite end parts of one of the shaft of the photosensitive body and the shaft of the developing unit and maintains a gap between the photosensitive body and the developing unit.

6. An image forming apparatus comprising:

a developing cartridge that comprises a body frame, a photosensitive body, a developing unit having a shaft in parallel to the photosensitive body, a driven part that is rotatably joined to the shaft of the developing unit, a transmission part that has a transmission shaft in parallel to the shaft of the developing unit and is connected to the driven part in a transmittable manner, a unit casing that rotatably supports the shaft of the developing unit and the transmission shaft, is rotatably supported to the body frame, and controls the developing unit to approach the photosensitive body if the unit casing rotates in the same direction as a rotation direction of the photosensitive body, and a cartridge driving part that is provided in the body frame and rotates the transmission part in the same direction as the rotation direction of the photosensitive body; and a main driving part that rotates the cartridge driving part.

7. The image forming apparatus according to claim 6, wherein the driven part has a pinion engaging part and the transmission part has a transmission engaging part that is engaged with the pinion engaging part.

8. The image forming apparatus according to claim 6, wherein the transmission part has a driven coupling part formed in a direction of a rotational axis of the transmission shaft and the driving part has a driving coupling part that is engaged with the driven coupling part in the direction of the rotational axis of the transmission shaft.

9. The image forming apparatus according to claim 8, wherein:

the developing cartridge further comprises a rotating disk;

the driven coupling part comprises a plurality of driven projections that projects toward the driving coupling part and is inserted in the rotating disk; and the driving coupling part comprises a plurality of driving projections that projects toward the driven coupling part and is inserted in the rotating disk, the driving projections being spaced from the driven projections in a predetermined direction.

10. The image forming apparatus according to claim 6, wherein the developing cartridge further comprises a gap maintaining member that maintains a gap between the photosensitive body and the developing unit.

11. A developing cartridge comprising:

a developing unit having a developing shaft;

a transmission part having a transmission shaft spaced apart from the developing shaft by a distance in a radial direction of the developing shaft;

a coupling part disposed to transfer a rotation power from an external source to the developing shaft through the transmission part;

a photosensitive body to be developed by the developing unit;

a unit casing to rotatably support the developing shaft and the transmission shaft; and a hinge shaft around which the unit casing is disposed to rotate, wherein the coupling part generates a moment applied to the transmission part to make the developing unit move toward the photosensitive body while rotating in a different direction from the developing unit.

12. The developing cartridge according to claim 11, wherein the coupling part comprises:

a rotation disk, which rotates along with the transmission part; and a driving part to transfer the rotation power from an external source to the rotation disk.

13. The developing cartridge according to claim 11, wherein the coupling part comprises:

a rotation disk having first and second grooves spaced apart from each other in a circumferential direction of the rotation disk; and a driving part which is received in the first groove and transfers the rotation power to the rotation disk, wherein the transmission part is received in the second groove to rotate along with the rotation disk.

14. The developing cartridge according to claim 11, wherein the coupling part comprises first portions spaced apart from a rotation axis of the transmission shaft to receive the rotation power from an external source and second portions spaced apart from the rotation axis of the transmission shaft to transfer the received rotation power to the developing shaft.

15. The developing cartridge according to claim 11, wherein the coupling part and the transmission part rotate in a first direction with respect to a rotation axis of the transmission shaft, and the developing unit rotates a second direction opposite to the first direction.

16. The developing cartridge according to claim 11, wherein the developing cartridge further compress a photosensitive body to be developed by the developing unit, the coupling part generates a rotation moment to the transmission part, and the rotation moment is in a range between a neutral moment and a negative moment where the developing unit is biased toward the photosensitive body.

17. The developing cartridge according to claim 16, wherein the rotation moment is not in a range between the neutral moment and a positive moment when the developing unit is biased away from the photosensitive body.

18. The developing cartridge according to claim 11, wherein the coupling part and the transmission part rotates with respect to a first rotation axis in a first direction, and the developing unit rotates with respect to a second rotation axis different from the first rotation axis in a second direction.

19. The developing cartridge according to claim 11, wherein a line connecting centers of the hinge shaft and the transmission shaft forms an angle with a line connecting centers of the hinge shaft and the developing unit, and the angle is greater than an angle formed by the line connecting the hinge shaft and the developing unit and a line connecting the center of the hinge shaft and a circumference of the developing unit.

* * * * *